US012140313B2

(12) United States Patent
Weilert et al.

(10) Patent No.: US 12,140,313 B2
(45) Date of Patent: Nov. 12, 2024

(54) SYSTEM FOR BURNING COMBUSTIBLE FUEL ABOVE A PLACEMENT SURFACE

(71) Applicant: Solo Brands, LLC, Grapevine, TX (US)

(72) Inventors: Jeffrey R. Weilert, Southlake, TX (US); Alexander K. Maghsadi, Lewisville, TX (US)

(73) Assignee: Solo Brands, LLC, Grapevine, TX (US)

( * ) Notice: Subject to any disclaimer, the term of this patent is extended or adjusted under 35 U.S.C. 154(b) by 0 days.

(21) Appl. No.: 18/408,011

(22) Filed: Jan. 9, 2024

(65) Prior Publication Data

US 2024/0151398 A1 May 9, 2024

Related U.S. Application Data

(63) Continuation of application No. 18/100,790, filed on Jan. 24, 2023, now Pat. No. 11,994,298, which is a continuation of application No. 17/886,239, filed on Aug. 11, 2022.

(51) Int. Cl.
*F24C 1/16* (2021.01)
*F24B 1/181* (2006.01)

(52) U.S. Cl.
CPC ..... *F24B 1/181* (2013.01); *F24C 1/16* (2013.01)

(58) Field of Classification Search
CPC ..... F24B 1/181; F24C 3/14; F24C 1/16
See application file for complete search history.

(56) References Cited

U.S. PATENT DOCUMENTS

| | | | |
|---|---|---|---|
| 685,194 | A | 10/1901 | Young |
| 904,188 | A | 11/1908 | Engle |
| 1,298,762 | A | 4/1919 | Milligan |
| 1,694,175 | A | 12/1928 | Hauser |
| D100,012 | S | 6/1936 | Ford |
| 2,614,553 | A | 10/1952 | Cox |
| 2,722,883 | A | 11/1955 | Rignell |
| 2,738,225 | A | 3/1956 | Meek |
| D196,018 | S | 8/1963 | Palmer et al. |
| 3,756,218 | A | 9/1973 | Simpson |
| D229,013 | S | 11/1973 | Storandt |
| D229,277 | S | 11/1973 | Chan |

(Continued)

FOREIGN PATENT DOCUMENTS

| | | | |
|---|---|---|---|
| CN | 2035756 | U | 4/1989 |
| CN | 201715561 | U | 1/2011 |

(Continued)

OTHER PUBLICATIONS

International Search Authority, International Search Report and Written Opinion, ISA/KR, PCT/US2019/063180, Mar. 26, 2020, 10 pages.

(Continued)

*Primary Examiner* — Alfred Basichas
(74) *Attorney, Agent, or Firm* — HAYNES AND BOONE, LLP

(57) ABSTRACT

A stand is provided for elevating a portable stove above a surface. The stand includes a plurality of legs. Each leg includes an outer link connected by a hinge. The outer link is thus movable to a position extending radially outward. Each leg also includes a foot coupled to the outer link.

30 Claims, 9 Drawing Sheets

(56) References Cited

U.S. PATENT DOCUMENTS

| | | | |
|---|---|---|---|
| 3,790,081 | A | 2/1974 | Thornton |
| 3,937,138 | A | 2/1976 | Tidwell |
| 3,951,082 | A | 4/1976 | Leggett |
| D258,259 | S | 2/1981 | Lindholm |
| D258,712 | S | 3/1981 | Jacobson |
| D273,264 | S | 4/1984 | Elliston |
| 4,735,135 | A | 4/1988 | Walker |
| 4,903,683 | A | 2/1990 | Larsen |
| 5,024,208 | A | 6/1991 | Hottenroth |
| 5,117,558 | A | 6/1992 | Hull |
| D355,809 | S | 2/1995 | Kothrade |
| D358,204 | S | 5/1995 | Ferrier |
| 5,490,452 | A | 2/1996 | Schlosser |
| D379,900 | S | 6/1997 | Gillam et al. |
| 5,638,808 | A | 6/1997 | Home |
| 5,651,356 | A | 7/1997 | Kaines |
| 5,797,386 | A | 8/1998 | Orr |
| 5,809,988 | A | 9/1998 | Wagner |
| 6,024,081 | A | 2/2000 | Libertini, Jr. |
| D422,452 | S | 4/2000 | Persson |
| D435,191 | S | 12/2000 | Cooper |
| 6,196,121 | B1 | 3/2001 | Crowl |
| 6,196,215 | B1 | 3/2001 | Chandaria |
| D442,422 | S | 5/2001 | Dabney |
| D444,991 | S | 7/2001 | Measom |
| 6,314,955 | B1 | 11/2001 | Boetcker |
| 6,393,717 | B1 | 5/2002 | Santos |
| 6,488,023 | B2 | 12/2002 | Pecoskie |
| 6,609,514 | B1 | 8/2003 | Bertolas |
| D488,023 | S | 4/2004 | Siegel et al. |
| D491,409 | S | 6/2004 | Siegel |
| D495,552 | S | 9/2004 | Siegel |
| D531,849 | S | 11/2006 | Turner |
| D534,756 | S | 1/2007 | Jensen |
| D549,300 | S | 8/2007 | Harrell |
| D607,265 | S | 1/2010 | Gaunaurd, III |
| D612,191 | S | 3/2010 | Taber |
| D612,662 | S | 3/2010 | Lorenz |
| D618,038 | S | 6/2010 | Davies |
| 7,810,484 | B2 | 10/2010 | Schlosser |
| D644,474 | S | 9/2011 | Wilgus |
| 8,087,410 | B2 | 1/2012 | Gregory |
| D658,426 | S | 5/2012 | Saunders |
| 8,272,601 | B2 | 9/2012 | Kocher |
| D683,999 | S | 6/2013 | Karlsson |
| 8,668,949 | B2 | 3/2014 | Wilson |
| D701,721 | S | 4/2014 | Jan |
| 8,991,382 | B1 | 3/2015 | Mau |
| D749,960 | S | 2/2016 | Bhattacharyya et al. |
| 9,328,928 | B2 | 5/2016 | Wehr |
| 9,844,300 | B2 | 12/2017 | Cedar |
| 10,098,502 | B2 | 10/2018 | Ohler |
| 10,125,995 | B2 | 11/2018 | Kohli |
| 10,222,092 | B1 | 3/2019 | Traeger |
| D858,729 | S | 9/2019 | Scott |
| 10,557,635 | B1 * | 2/2020 | Wanderscheid ..... F24C 1/16 |
| 10,743,712 | B2 | 8/2020 | Skillman |
| D923,163 | S | 6/2021 | Jan |
| 11,092,342 | B2 | 8/2021 | Harrington |
| 2006/0219233 | A1 | 10/2006 | Sorenson |
| 2007/0137634 | A1 | 6/2007 | Traeger |
| 2009/0165772 | A1 | 7/2009 | Hunt |
| 2010/0043775 | A1 | 2/2010 | Phillips |
| 2011/0073723 | A1 | 3/2011 | Ashpole |
| 2011/0180527 | A1 | 7/2011 | Abbott |
| 2012/0017884 | A1 | 1/2012 | Van Den Hoff |
| 2012/0145139 | A1 | 6/2012 | Deeds |
| 2012/0222668 | A1 | 9/2012 | Unger |
| 2014/0007778 | A1 | 1/2014 | Marks |
| 2014/0026765 | A1 | 1/2014 | Fou |
| 2014/0165993 | A1 | 6/2014 | Ahmed |
| 2014/0238378 | A1 | 8/2014 | Scott |
| 2015/0068512 | A1 | 3/2015 | Mehler |
| 2015/0110939 | A1 | 4/2015 | Benson |
| 2015/0211743 | A1 | 7/2015 | Defoort |
| 2017/0059178 | A1 | 3/2017 | Lando et al. |
| 2017/0363325 | A1 | 12/2017 | Diurlin |
| 2019/0313851 | A1 | 10/2019 | Shemp |
| 2020/0049344 | A1 | 2/2020 | Masterson |
| 2020/0208842 | A1 | 7/2020 | Jan et al. |
| 2020/0309369 | A1 | 10/2020 | Jan |
| 2021/0018180 | A1 | 1/2021 | Jan |
| 2021/0048188 | A1 | 2/2021 | Harrington |
| 2021/0199301 | A1 | 7/2021 | Poggi |
| 2021/0274970 | A1 | 9/2021 | Stoltzfus |
| 2021/0282592 | A1 | 9/2021 | Jan |
| 2022/0186931 | A1 | 6/2022 | Jan |

FOREIGN PATENT DOCUMENTS

| | | | |
|---|---|---|---|
| CN | 103528100 | A | 1/2014 |
| CN | 204388128 | U | 6/2015 |
| DE | 202013002524 | U1 | 5/2013 |
| JP | 2000342462 | A | 12/2000 |
| JP | 2001161169 | A | 6/2001 |
| JP | 10323289 | A | 7/2003 |
| JP | 2003190011 | A | 7/2003 |
| KR | 200295935 | Y1 | 11/2002 |
| KR | 100898493 | B1 | 5/2009 |
| KR | 1020200122766 | A | 10/2020 |
| WO | 2017078762 | A1 | 5/2017 |
| WO | 2018160767 | A1 | 9/2018 |
| WO | 2021111262 | A2 | 6/2021 |

OTHER PUBLICATIONS

International Search Authority, International Search Report and Written Opinion, for PCT/US2021/020687, mailed Aug. 5, 2021, 11 pages.

Solo Stove, webpage capture: https://www.solostove.com/solo-stove-bonfire, 2017, 8 pages.

Screen captures from YouTube video clip entitled "Solo Stove Bonfire: Best Gear of 2017," 4 pages, uploaded on May 14, 2017 by user "Canadian Prepper". Retrieved from Internet: https://www.youtube.com/watch?v=Vo_J_flWq5g.

Camping stove, https://www.kickstarter.com/projects/340672218/solo-stove-campfire-backpack-camp-survive/description, 21 pages (2014).

Korean Intellectual Property Office, International Search Report and Written Opinion, PCT/US2022/011365, May 3, 2022, 12 pages.

International Search Report and Written Opinion for related International Application No. PCT/US2023/071938, mailed Nov. 28, 2023; 9 pages.

* cited by examiner

SYSTEM FOR BURNING COMBUSTIBLE FUEL ABOVE A PLACEMENT SURFACE

CROSS REFERENCE TO RELATED APPLICATIONS

This application is a continuation of U.S. patent application Ser. No. 18/100,790 filed Jan. 24, 2023, entitled PORTABLE STOVE WITH FOLDING STAND, which is a continuation of U.S. patent application Ser. No. 17/886,239, filed Aug. 11, 2022, entitled PORTABLE STOVE WITH FOLDING STAND, which is hereby incorporated by reference in its entirety as though fully set forth herein.

This application is related to U.S. Design patent application Ser. No. 29/865,767, filed Aug. 11, 2022, entitled FIRE PIT STAND, and to U.S. Design patent application Ser. No. 29/865,766, filed Aug. 11, 2002, entitled FIRE PIT, both of which are hereby incorporated by reference in their entirety as though fully set forth herein.

FIELD

The subject matter described herein relates to stand for a portable stove and to a portable stove. The stand may offset the portable stove from a surface, such as a non-heatproof surface.

BACKGROUND

Camp stoves and other portable stoves are often used in backpacking, picnics, backyard cookouts, and at other times. The components of a portable stove may become hot during use. This may present a risk of heat damage when, for example, a hot metal stove is placed on a non-heatproof surface such as a vehicle hood, picnic table, forest floor, etc.

The information included in this Background section of the specification, including any references cited herein and any description or discussion thereof, is included for technical reference purposes only and is not to be regarded as subject matter by which the scope of the disclosure is to be bound.

SUMMARY

Disclosed is a portable stand for a portable cooking stove usable in environments where a heatproof surface is not available for placement of the stove. Together, the stove and stand may create a system that can be used in conjunction with pots and pans to, for example, boil water, cook eggs, heat rehydrated foods, etc. In some aspects, the stand is a removable, foldable stand that can be disposed inside the stove body during transportation or storage of the stove. In its unfolded state, the stand includes legs and feet that are sized and shaped to hold the stove bottom a sufficient distance away from a tabletop or other surface.

The stand disclosed herein has particular, but not exclusive, utility for camping, backpacking, and picnics. One general aspect of the stove and stand system includes a stand for elevating a portable stove above a surface. The stand includes a central intersection and a plurality of legs, where each leg includes: an inner link extending radially outward from the central intersection; an outer link connected to the inner link by a hinge, the outer link movable to a position extending radially outward from the inner link; and a foot coupled to and extending transverse to the outer link, the foot including: a standoff extending transverse from the outer link in a first direction; and an interference arm extending transverse from the outer link in a second direction opposite the first direction.

Implementations may include one or more of the following features. In some embodiments, the hinges, the inner link, and the outer link are structurally configured such that the outer link can rotate downward but not upward. In some embodiments, when the stand is configured such that when the stove is rested on the stand, the bottom portion of the stove rests on at least one of the central region or the plurality of legs. In some embodiments, a surface of each standoff portion includes a pad fixedly attached to the standoff portion. In some embodiments, the pads include at least one of a thermal insulation property, an anti-slip property, or a vibration suppression property. In some embodiments, the pads include a rubbery material. In some embodiments, the outer link of each leg is movable to a folded position. In some embodiments, when at least some of the outer links are in the folded position, the stand is positionable inside the stove. In some embodiments, the height of the standoffs is selected to minimize heat transfer between the stove and the surface. In some embodiments, when all of the outer links are in the position extending radially outward, a width of the stand is such that the stove fits between all of the interference arms, and such that the stove is arrested from motion in any radially outward direction.

One general aspect includes a stove and stand system. The stove and stand system includes a stove body including an outer width, a cavity having an inner width, and a bottom portion. The stove and stand system also includes a stand including: a central region; and a plurality of legs extending radially outward from the central region, each leg including: an inner link extending radially outward from the central region; an outer link pivotably attached to the inner link and pivotable from a first position parallel with the inner link to a second position angled relative to the inner link, the stand having a first width when the outer links are in the first position and having a second width smaller than the first width when the outer links are in the second position, the first width being greater than the outer width of the stove body and the second width being smaller than the inner width of the cavity of the stove body.

Implementations may include one or more of the following features. In some embodiments, the stand includes a foot at an end of the outer link, the foot including: a standoff extending transverse from the outer link in a first direction; and an interference arm extending transverse from the outer link in a second direction opposite the first direction. In some embodiments, the stove and stand are configured such that when the stove is on the stand: the bottom portion of the stove rests on at least one of the central region and the plurality of legs, and the standoff of each leg arrests the stove from moving laterally beyond a radial position. In some embodiments, the height of the standoffs is selected to minimize heat transfer between the stove and the surface. In some embodiments, the stove and stand are configured such that when at least some the outer links are in the second position, the stand can be stored within the cavity. In some embodiments, the hinges, the inner link, and the outer link are structurally configured such that the outer link can rotate downward but not upward. In some embodiments, a surface of each standoff portion includes a pad fixedly attached to the standoff portion. In some embodiments, the pads include a rubbery material providing at least one of a thermal insulation property, an anti-slip property, or a vibration suppression property.

One general aspect includes a stove and stand system. The stove and stand system includes a stove body including an outer width, a cavity having an inner width, and a bottom portion. The stove and stand system also includes a stand including: a central region; and a plurality of legs extending radially outward from the central region, each leg including: an inner link extending radially outward from the central region; an outer link pivotably attached to the inner link and pivotable from a first position parallel with the inner link to a second position angled relative to the inner link, the stand having a first width when the outer links are in the first position and having a second width smaller than the first width when the outer links are in the second position, the stand being sized so that the central region is introducible into the cavity when in the second position. In some embodiments, the stand includes a foot at an end of the outer link, the foot including: a standoff extending transverse from the outer link in a first direction; and an interference arm extending transverse from the outer link in a second direction opposite the first direction.

In some implementations, the present disclosure is directed to a camp stove that includes a stove body comprising an outer width, a cavity having an inner width, and a bottom portion. An outer surface may define the outer width and may have a plurality of rows of ventilation holes extending about a circumference of the stove body. The rows may be disposed along a lower portion of the outer surface. An inner surface may define the inner width and may form a combustion chamber. The inner surface may have a row of ventilation holes extending about the inner circumference of the stove body in an upper portion of the inner surface. The ventilation holes in the outer surface may be in fluid communication with a) the ventilation holes in the inner surface through a vertical passage between the inner surface and the outer surface, and b) with the combustion chamber through a horizontal passage extending above the bottom portion.

In some aspects, the camp stove may include three rows of holes extending about the circumference of the stove body. In some aspects, the ventilation holes in the inner surface may have a width greater than a width of the ventilation holes in the outer surface. In some aspects, the ventilation holes in the inner surface are formed in a different number of rows (such as one) than the number of rows of the ventilation holes in the outer surface and the ventilation holes in the inner surface have a width greater than a width of the ventilation holes in the outer surface.

This Summary is provided to introduce a selection of concepts in a simplified form that are further described below in the Detailed Description. This Summary is not intended to identify key features or essential features of the claimed subject matter, nor is it intended to limit the scope of the claimed subject matter. A more extensive presentation of features, details, utilities, and advantages of the stove and stand system, as defined in the claims, is provided in the following written description of various embodiments of the disclosure and illustrated in the accompanying drawings.

BRIEF DESCRIPTION OF THE DRAWINGS

Illustrative embodiments of the present disclosure will be described with reference to the accompanying drawings, of which.

DETAILED DESCRIPTION

Figure 1:
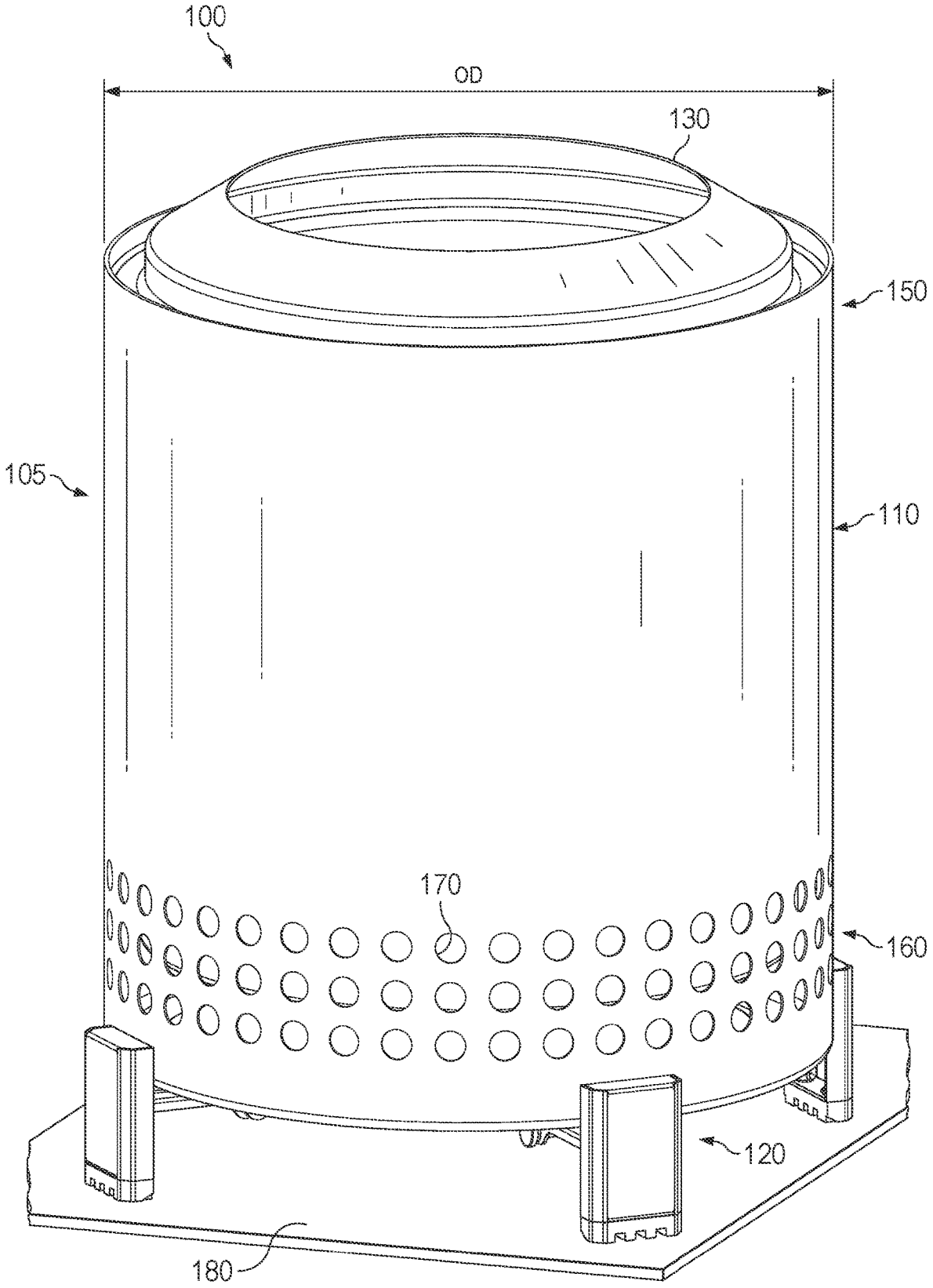
FIG. 1 is a front perspective view of an example stove and stand system, in accordance with aspects of the present disclosure.

Disclosed herein is a stand for a portable stove for use in environments where a heatproof surface is not available on which to place the stove. The stand may be used with a portable stove that can burn solid fuel such as sticks, branches, paper, cardboard, etc. The stove can be used in conjunction with pots and pans to, for example, boil water, cook eggs, heat rehydrated foods, etc. Alternatively, or in addition, the stove may be used for roasting, browning, or toasting foods, or as a heat source. In some aspects, the stand is foldable. In its folded state, the stove stand can be disposed inside the stove body for transportation or storage. In its unfolded state, the stove stand includes legs and feet that are sized and shaped to restrain movement of the stove, and to offset the bottom surface of the stove a safe distance away from the tabletop or other placement surface during cooking or other use of the stove.

For the purposes of promoting an understanding of the principles of the present disclosure, reference will now be made to the embodiments illustrated in the drawings, and specific language will be used to describe the same. It is nevertheless understood that no limitation to the scope of the disclosure is intended. Any alterations and further modifications to the described devices, systems, and methods, and any further application of the principles of the present disclosure are fully contemplated and included within the present disclosure as would normally occur to one skilled in the art to which the disclosure relates. In particular, it is fully contemplated that the features, components, and/or steps described with respect to one embodiment may be combined with the features, components, and/or steps described with respect to other embodiments of the present disclosure. For the sake of brevity, however, the numerous iterations of these combinations will not be described separately.

These descriptions are provided for exemplary purposes only and should not be considered to limit the scope of the stove and stand system. Certain features may be added, removed, or modified without departing from the spirit of the claimed subject matter.

FIG. 1 is a front perspective view of an example stove and stand system 100, in accordance with aspects of the present disclosure. The stove and stand system 100 includes a stove 105 and a stand 120. The stove 105 includes stove body 110 with a width or outer diameter OD. In some embodiments, the outer diameter OD is between 6" and 12". In some embodiments, the outer diameter OD is between 5" and 15", although other diameters, both larger and smaller, may be used instead or in addition.

In the example shown in FIG. 1, the stove body includes a plurality of ventilation holes 170 in a lower portion 160 of the stove body 110. In this particular implementation, there are three horizontal rows of holes, equally spaced and extending entirely about the circumference of the stove body. In order to provide sufficient airflow, but also balancing a desire to keep the hole size small, the ventilation holes 170 are provided in multiple rows of small holes instead of a single row of larger holes. Since the stove 105 is sized to be used on a table-top, it may be advantageous to provide smaller holes instead of larger holes to reduce the chance of users inserting debris, fingers, or other items into the ventilation holes 170, as the stove rests on a table about which people are sitting or standing. Accordingly, in some implementations, the holes are arranged in three rows as shown in FIG. 1 with each hole having a diameter sized less than a diameter of an average finger. For example, in some implementations, each hole has a diameter in a range of about 0.3 to about 0.75 inches. In some implementations, each hole has a diameter in a range of about 0.4 to 1 inch. Even still, multiple rows, such as three rows of holes larger than 1 inch are also contemplated. In some examples, the holes have a diameter in a range of about 0.5 to 1.5 inches. By summing the area of the smaller holes, placed in horizontal rows, sufficient airflow can still be provided to provide ventilation to the upper ventilation holes and to the bottom of the burn chamber. Although described as having diameters, each ventilation hole 170 may have a perimeter shape that is not round, and therefore the holes may have a width instead of a diameter.

In some examples, the stove body 110 has a generally cylindrical shape with a circular cross section, although in other examples it may have shapes with other cross-sections, including but not limited to oval, square, rectangular, triangular, or polygonal. The stove 105 may be used to provide heat, provide ambience, for cooking, or for other desirable purposes. In this example, the stove 105 includes a top bezel or pot support 130 that rests on an upper portion 150 of the stove body 110. The top bezel or pot support 130 is configured to support the weight of, for example, a frying pan of a water-filled pot, although the stove can be used with its top open for roasting marshmallows, hot dogs, or other foods.

The example stove and stand system 100 also includes the stand 120. In the example shown in FIG. 1, the stove body 110 rests removably on the stand 120. The stand is configured to support the weight of the stove body 110, including any fuel that may be inside the stove body, and including the loaded cooking weight of pans, water-filled pots, etc. The stand 120 is also sized and shaped to arrest lateral motion of the stove body 110, and to prevent the stove body 110 from directly contacting a placement surface 180 on which the stand rests. Thus, for example, if the placement surface 180 is a non-heatproof surface (e.g., a non-heatproof picnic table, non-heatproof countertop, plastic table, forest floor covered in pine needles or leaf litter, etc.), then the stand 120 may protect the placement surface 180 by minimizing the amount of heat from the bottom portion 160 of the stove body 110 that is transferred directly to the placement surface 180 via conduction. This may limit or prevent heat damage to the placement surface 180 from heat generated by the combustion of fuel within the stove body 110.

This configuration advantageously permits the stove and stand system 100 to serve as an aesthetic source of firelight ambience, a heat source, and/or a cooking stove, whether simultaneously or at different times. The size and structure permit the stove and stand system to be used on a tabletop or other surface, about which people may socially gather to build relationships, share time, and create memories. For example, the stove and stand system 100 may be placed on the placement surface 180 as a tabletop centerpiece that allows users seated around the table to see, read, warm their hands, and/or roast food such as marshmallows or hot dogs, or heat foods in a cooking pot, pan, or grill that is rested on the top bezel 130. The simple proximity of a stove sized to fit on a tabletop to people gathered about the table may create certain interactions not achievable by a firepit or stove intended to rest on the ground. Such multi-functionality, in a small device that fits on a tabletop or other surface, and is easily portable and storable, provides clear advantages over existing firepits, camp stoves, tiki torches, and other combustion devices.

Before continuing, it should be noted that the examples described herein are provided for purposes of illustration and are not intended to be limiting. Other devices and/or device configurations may be utilized to carry out the operations described herein.

Figure 2:
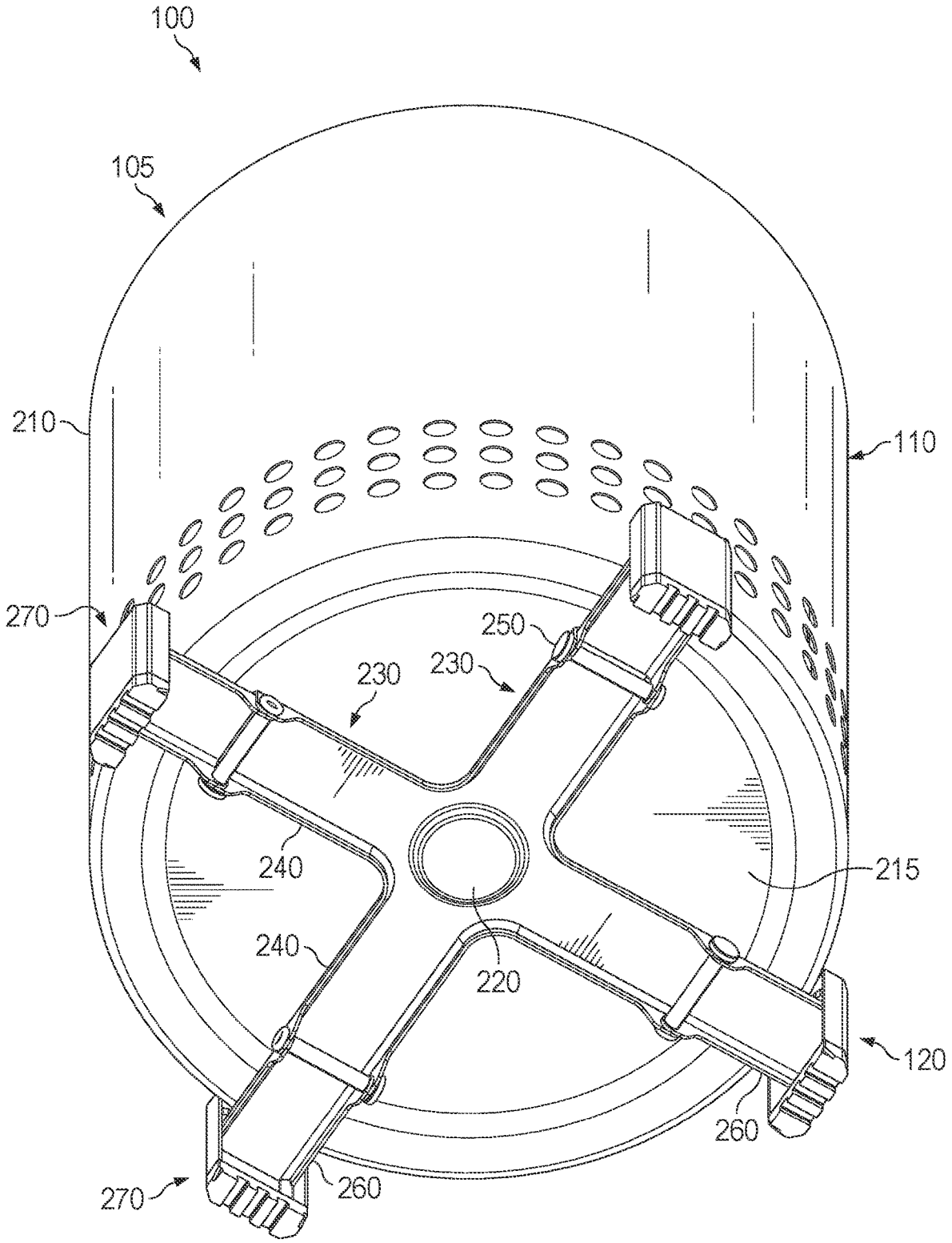
FIG. 2 is perspective bottom view of an example stove and stand system in accordance with aspects of the present disclosure.

FIG. 2 is perspective bottom view of an example stove and stand system 100, in accordance with aspects of the present disclosure. The stove and stand system 100 includes the stove body 110, which includes an outer wall 210 and a bottom surface 215. In some examples, when the stove body 110 contains burning fuel, the amount of heat generated by the combustion may be such that the outer wall 210 and bottom surface 215 may become hot enough to damage materials or surfaces with which they are in contact.

FIG. 2 also shows the bottom of the stand 120. When the stove body 110 is placed on the stand 120, the stand 120 prevents the placement surface 180 (FIG. 1) from coming in direct contact with the bottom surface 215 of the stove body 210. The stand 210 includes a central region 220, and a plurality of legs 230 projecting radially outward from the central region. In an example, the legs 230 project horizontally, although in other examples the legs 230 may be angled upward or downward. In some examples, a minimum of three legs 230 may be needed to support the stove body 110 in a stable manner. However, depending on the implementation, the stand 120 may include only two legs 230, or may include four or more legs 230, without departing from the spirit of the present disclosure.

Each leg 230 includes an inner link 240 that projects radially from the central region 220. In some examples, the inner links 240 and the central region 220 form a single piece that may, for example, be stamped from a sheet metal blank. In other examples, the inner links 240 may be attached to the central region 220 by welds, solder, brazing, bolts, screws, rivets, pins, or otherwise. Each leg also includes an outer link 260 that is rotatably attached to the inner link 240 by a hinge 250 located at a radially outermost portion of the inner link 240 and a radially innermost portion of the outer link 260. The hinge 250 is configured to transition the outer link 260 from a first, unfolded configuration (shown here in FIG. 2) to a second, folded configuration (shown below in FIGS. 8 and 9). In this example, the hinge 250 pivots around a hinge pin. However, other implementations use alternative hinge types. Yet other implementations utilize an outer link that telescopes between a first configuration and a smaller second configuration.

Each leg also includes a foot 270, located at a radially outermost portion of the outer link 260 such that, when the stove body 110 is placed on the stand 120, the bottom surface 215 of the stove body 110 is stood off from the placement surface by a sufficient distance to limit or prevent heat damage to the placement surface 180 from heat generated by the combustion of fuel within the stove body 110, and such that the stove body 110 is arrested from lateral movement in a radial or horizontal direction.

Figure 3:
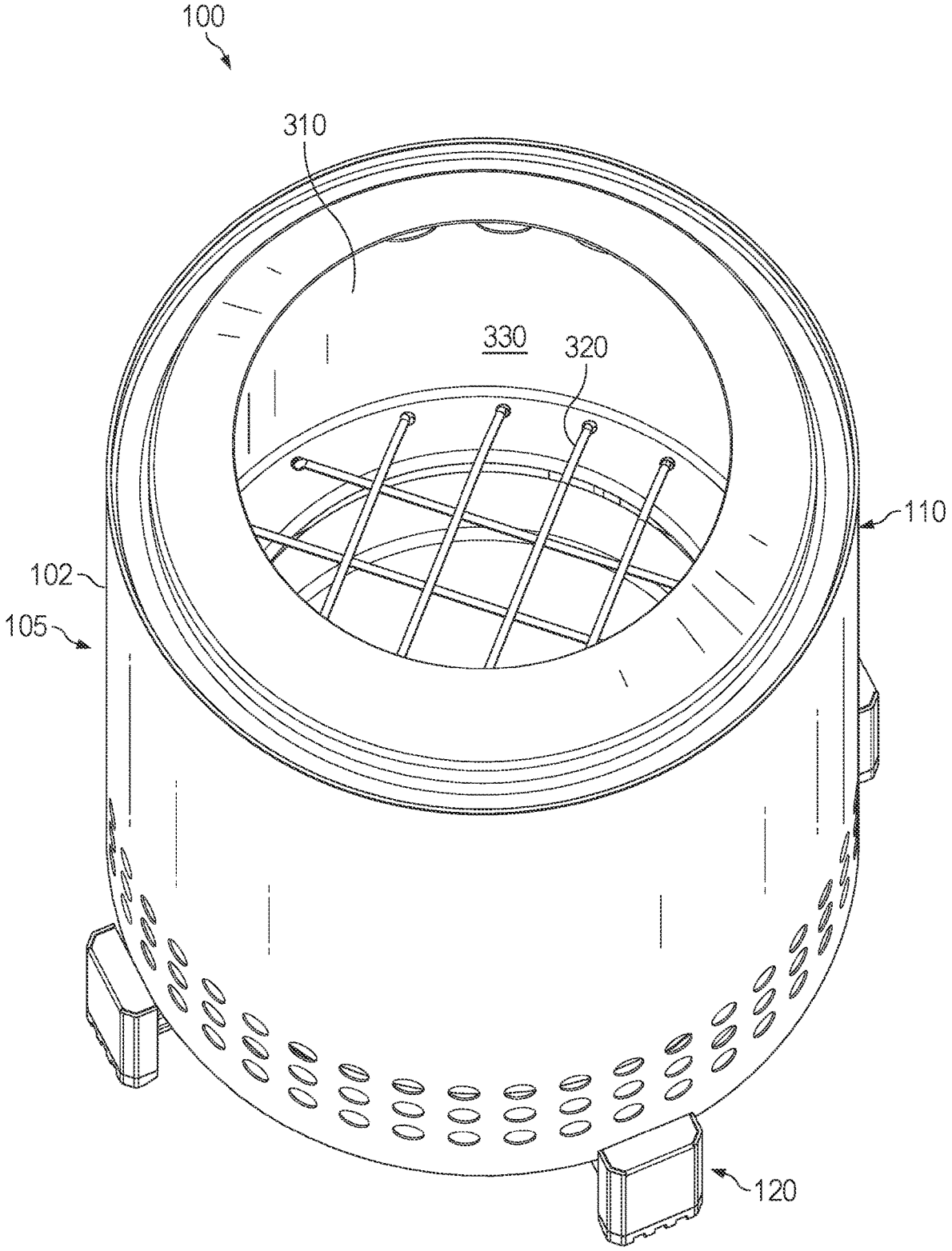
FIG. 3 is a perspective top view of an example stove and stand system, in accordance with aspects of the present disclosure.

FIG. 3 is a perspective top view of an example stove and stand system 100, in accordance with aspects of the present disclosure. Visible are the stove body 110 and stand 120. In addition to an outer wall 102, the stove body includes an inner wall 310 spaced from the outer wall 102 and defining a combustion cavity 330. Within the combustion cavity 330 is a fire grate 320, which may for example support a load of combustible solid fuel such as sticks, branches, paper, cardboard, etc.

Figure 4:
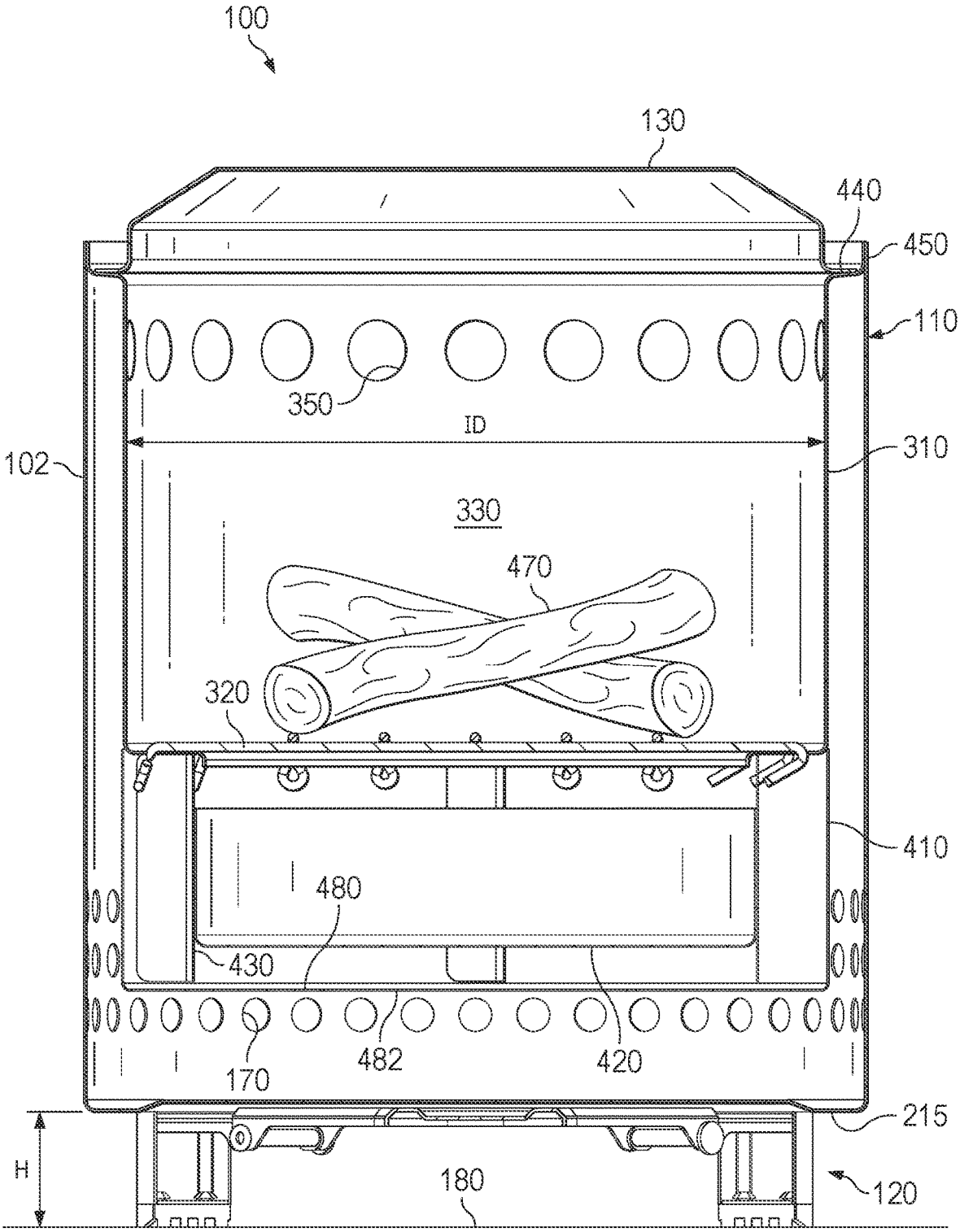
FIG. 4 is a front cross-sectional view of an example stove and stand system, in accordance with aspects of the present disclosure.

FIG. 4 is a front cross-sectional view of an example stove and stand system 100, in accordance with aspects of the present disclosure. The stove body 110 includes the outer wall 102 along with an inner wall 310 that is spaced from the outer wall 102 and defines an inner width or inner diameter ID of the combustion chamber 330. The inner wall 310 includes a top lip 440 that enables the inner wall 310 to hang removably from a top edge 450 of the outer wall 210. An upper portion of the inner wall 310, below the top lip 440, includes a plurality of ventilation holes 350.

The top bezel or pot support 130 may for example rest removably on the top lip 440. The inner wall 310 rests removably on a choke pan 410. Within the combustion chamber 330 is a quantity of combustible solid fuel 470, supported by the fuel or fire grate 320. The fire grate 320 is supported by the choke pan 410. Within the choke pan 410, below the fire grate 320, is an ash pan 420, which receives ashes and other combustion remnants that fall through the fire grate 320 as the fuel 470 is combusted. The ash pan 420 is positioned centrally within the choke pan 410 by a plurality of ash pan spacers 430 (e.g., three, four, or more ash pan spacers 410), which project inward from the wall of the choke pan. Below the ash pan 420 is an air-damper 480 with a central air passage 482.

The bottom surface 215 of the stove body 110 is attached adjacent to a bottom edge of the outer wall 102. The bottom surface 215 of the stove body 110 may rest on the stand 120, such that the bottom surface 215 is spaced from the placement surface 180 (e.g., a tabletop) by a height H, which limits heat transfer between the bottom surface 215 and the placement surface 180. This may help to prevent heat damage to the placement surface 180, in cases where the placement surface 180 is a non-heat-resistant surface.

Air may flow through the three rows of ventilation holes 170, and then divide to flow upward to the ventilation holes 350 and to flow toward the combustion chamber 330 by flowing between the air-damper 480 and the bottom surface 215, through the central air passage 482, and around the bottom of the ash pan 420, upward toward the fire grate 320, and above the ash pan 420 into the combustion chamber 330. In addition, the configuration shown in FIG. 4 can enable secondary combustion of unburnt volatile organic compounds (VOCs) emitted by the fuel 470 during combustion. When a fire is lit, rising hot air and the absence of oxygen created by the combustion process creates a vacuum at the bottom of the burn chamber. This vacuum draws oxygen in through the three rows of ventilation holes 170 at the bottom portion of the outer wall 102, horizontally between the air-damper 480 and the bottom surface 215, upward through the central air passage 482, and around the bottom of the ash pan 420, upward toward the fire grate 320, and above the ash pan 420 into the combustion chamber 330 to fuel the fire on the fuel or fire grate. At the same time, additional oxygen travels from the three rows of ventilation holes 170 vertically upward in a gap between the outer wall 102 and the inner wall 310, where the oxygen is preheated by the temperature of the inner wall 310. The oxygen continues to then flow back into the combustion chamber 330 through the upper ventilation holes 350, for additional combustion of VOCs within the column of heat and flame rising in the combustion chamber 330. Such secondary combustion can not only increase heat and light output of the stove and stand system 100, but also decrease the production of smoke by ensuring a more complete combustion of the fuel 470.

Figure 5:
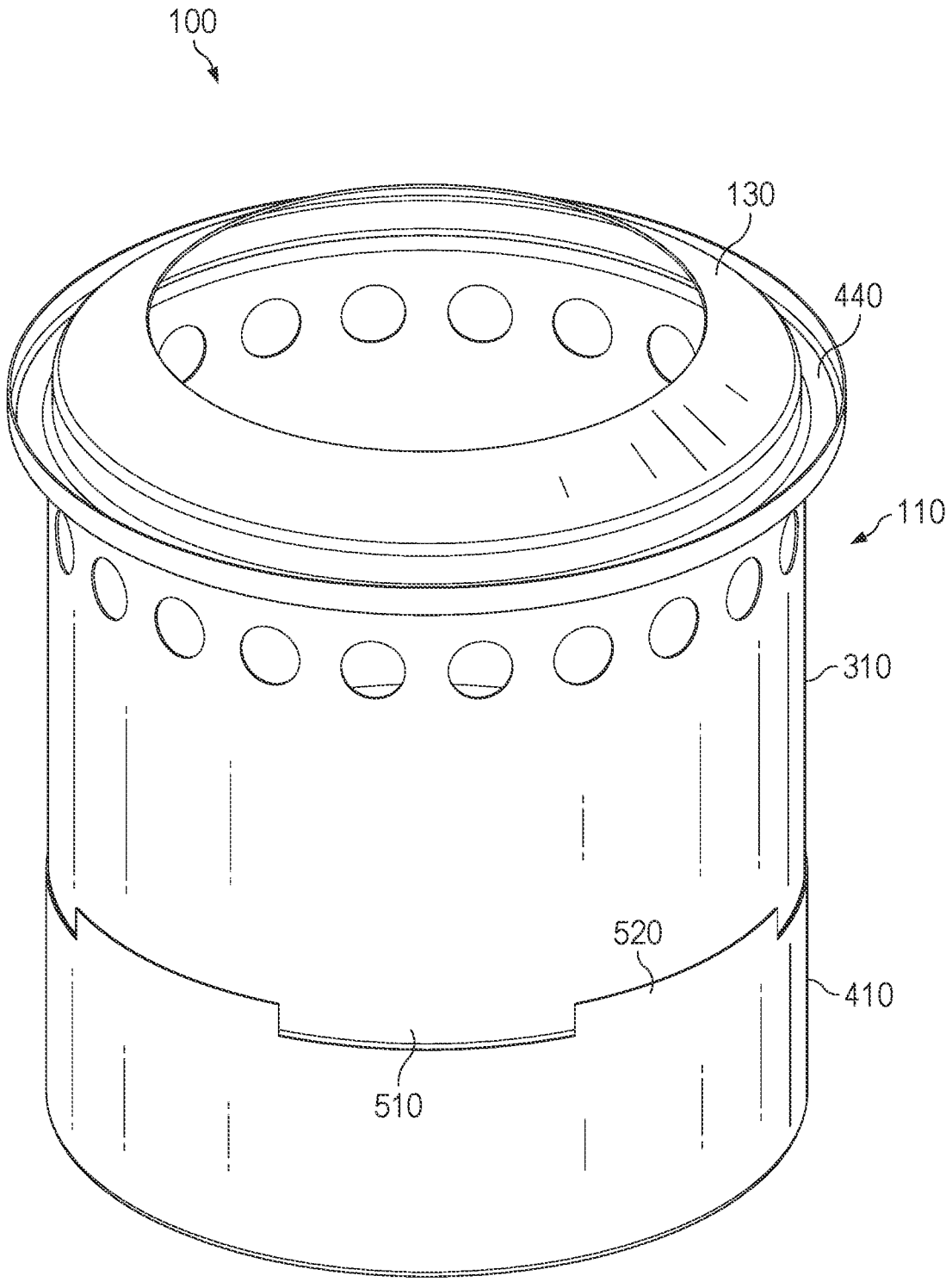
FIG. 5 is a front perspective view of the stove body of an example stove and stand system, with the outer wall and stand removed for clarity, in accordance with aspects of the present disclosure.

FIG. 5 is a front perspective view of the stove body 110 of an example stove and stand system 100, with the outer wall 102 and stand 120 removed for clarity, in accordance with aspects of the present disclosure. Visible are the top bezel or pot support 130, top lip 440, inner wall 310, and choke pan 410. In the example shown in FIG. 5, a lower edge 510 of the inner wall 310 rests on an upper edge 520 of the choke pan 410. In some embodiments, the shape of the inner wall 310, choke pan 410, the lower edge 510, and upper edge 520 are selected such that the lower edge 520 and upper edge 510 interlock. This may, for example, arrest the inner wall 310 from rotating relative to the choke pan 410, or arrest the choke pan 410 from rotating relative to the inner wall 310. The inner wall 310 includes a plurality of ventilation holes 350 that in this implementation are different than the ventilation holes 170. The ventilation holes 350 may have a larger diameter and may be formed in a single row instead of multiple rows.

Figure 6:
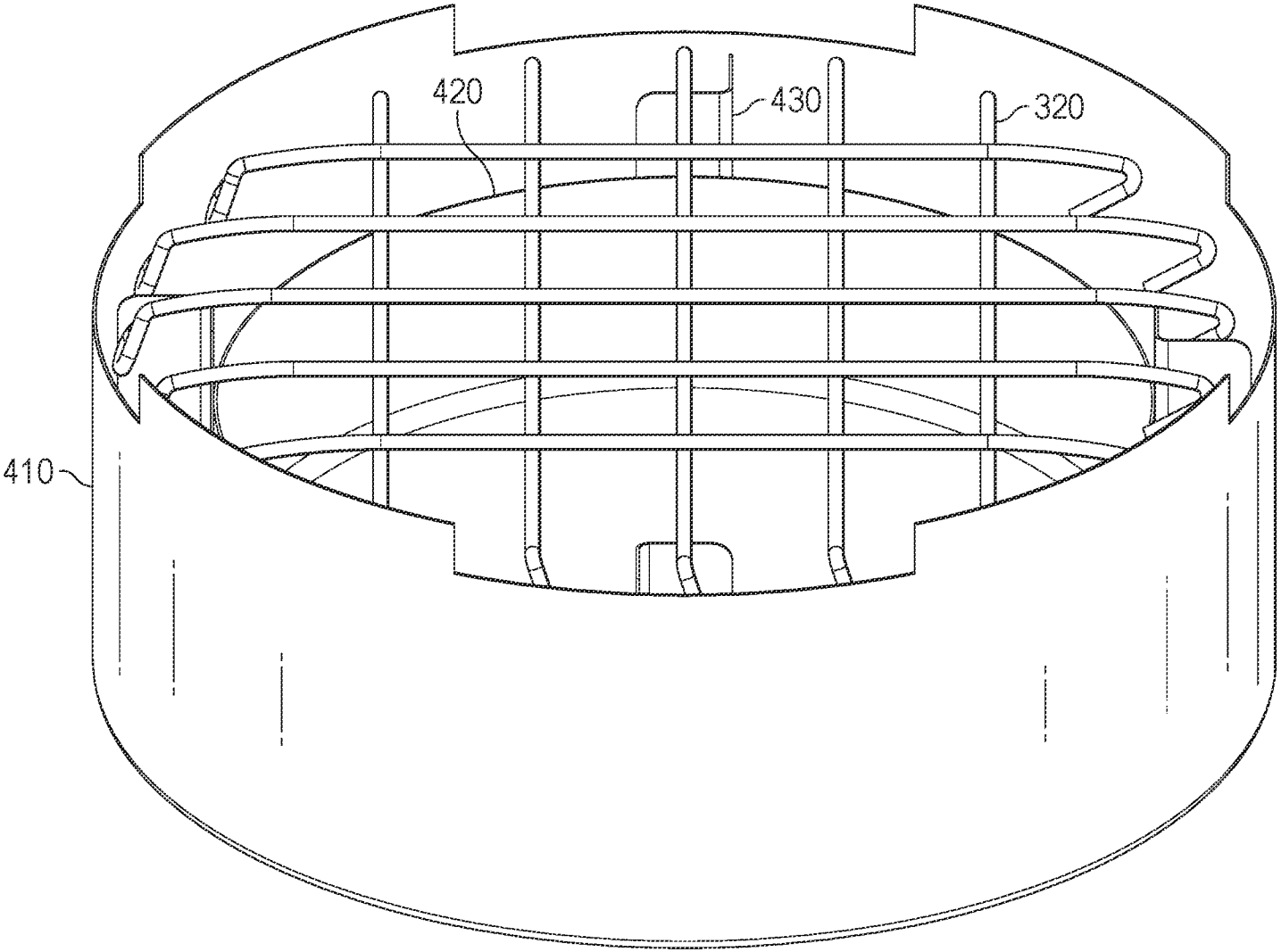
FIG. 6 is a front perspective view of the stove body of an example stove and stand system, with the outer wall, stand, top bezel, and inner wall removed for clarity, in accordance with aspects of the present disclosure.

FIG. 6 is a front perspective view of the stove body 110 of an example stove and stand system 100, with the outer wall 102, stand 120, top bezel 130, and inner wall 310 removed for clarity, in accordance with aspects of the present disclosure. Visible are the fire grate 320, choke pan 410, ash pan 420, and ash pan spacers 430.

Figure 7:
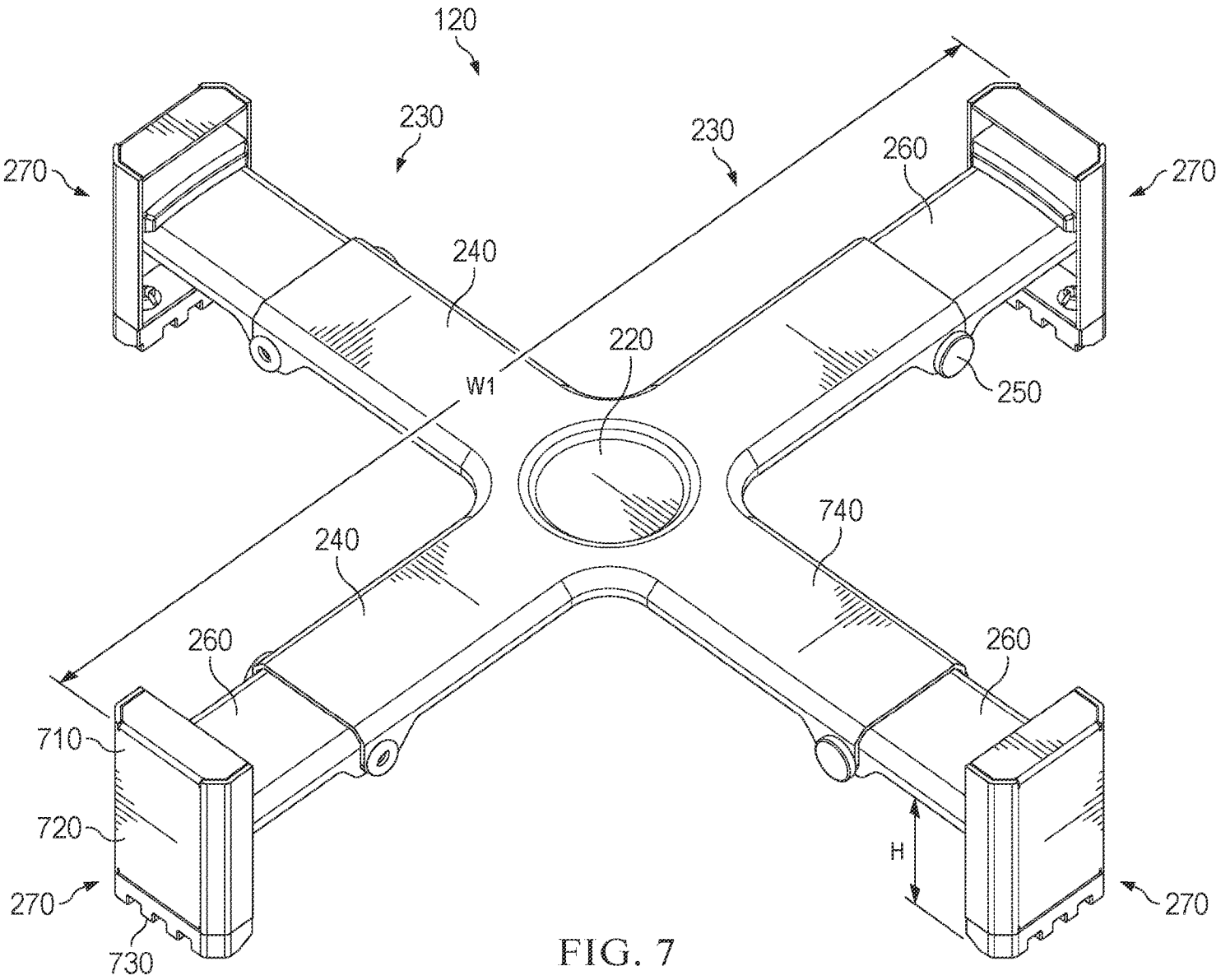
FIG. 7 is a top perspective view of the stand of an example stove and stand system, in an unfolded configuration, in accordance with aspects of the present disclosure.

FIG. 7 is a top perspective view of the stand 120 of an example stove and stand system, in an unfolded configuration, in accordance with aspects of the present disclosure. Visible are the central region 220, legs 230, inner links 240, hinges 250, outer links 260, and feet 270. As shown in FIG. 7, in the unfolded configuration, the stand 120 has a width W1 that is greater than the outer diameter of the stove body, such that the stove body can rest removably on the stand.

In the example in FIG. 7, each foot 270 extends laterally from an end of one of the outer links 260. Each foot is rigidly connected to the outer link 260. Accordingly, the foot 270 may be welded or otherwise fixed or formed at the end of the outer links 260. In other implementations, the foot 270 may be attached via a hinge or other connection. Each foot 270 includes an interference arm 710 and a standoff 720. The interference arm 710 extends transverse from its respective outer link 260 (e.g., in an upward direction as shown). The interference arms 710 are positioned such that they can arrest motion of the stove body in a lateral or radial direction (e.g., away from the central region 220). Each foot 270 also includes a standoff 720 that extends transverse from its respective outer link 260 (e.g., in a downward direction as shown). In the example shown, the interference arm 710 and standoff 720 are formed together as a single structure (e.g., by stamping a piece of sheet metal), extending both above and below the outer link 260. In an example, the foot 270 is attached to the outer link 260 with welds, solder, brazing, bolts, screws, rivets, pins, or otherwise. In some examples, each foot may also include a pad 730. The pad 730 may for example be or include a rubbery material (e.g., silicone rubber) that provides heat resistance, thermal insulation, slip resistance, vibration resistance, cushioning, or combinations thereof.

The standoff 720 and pad 730 are sized and shaped such that a top surface 740 of the stand 120, on which the stove body will rest, is a height H above the placement surface (e.g., a wooden picnic table). Depending on the implementation, the bottom surface of the stove body may rest on at least a portion of the central region 220, at least a portion of the inner links 240, at least a portion of the outer links 260, at least a portion of the interference arms 710, or any combination thereof. In the implementation shown, the central region 220 is also an intersection of the inner links 240. The inner links 240 cooperate with and overlap the outer links 260 in a manner that allows the inner link to fold from a position parallel to the inner link in only one direction. Accordingly, when loading applied to the stand 220, the overlapping nature of the inner links 240 and the outer links 260 prevent the inner link from pivoting beyond parallel so that the central region 220 is maintained at the height H. That is, the overlapping nature of the inner links 240 and the outer links 260 may prevent the central region from collapsing. In the example shown, the central region and inner links 240 are all formed as a single monolithic component.

Figure 8:
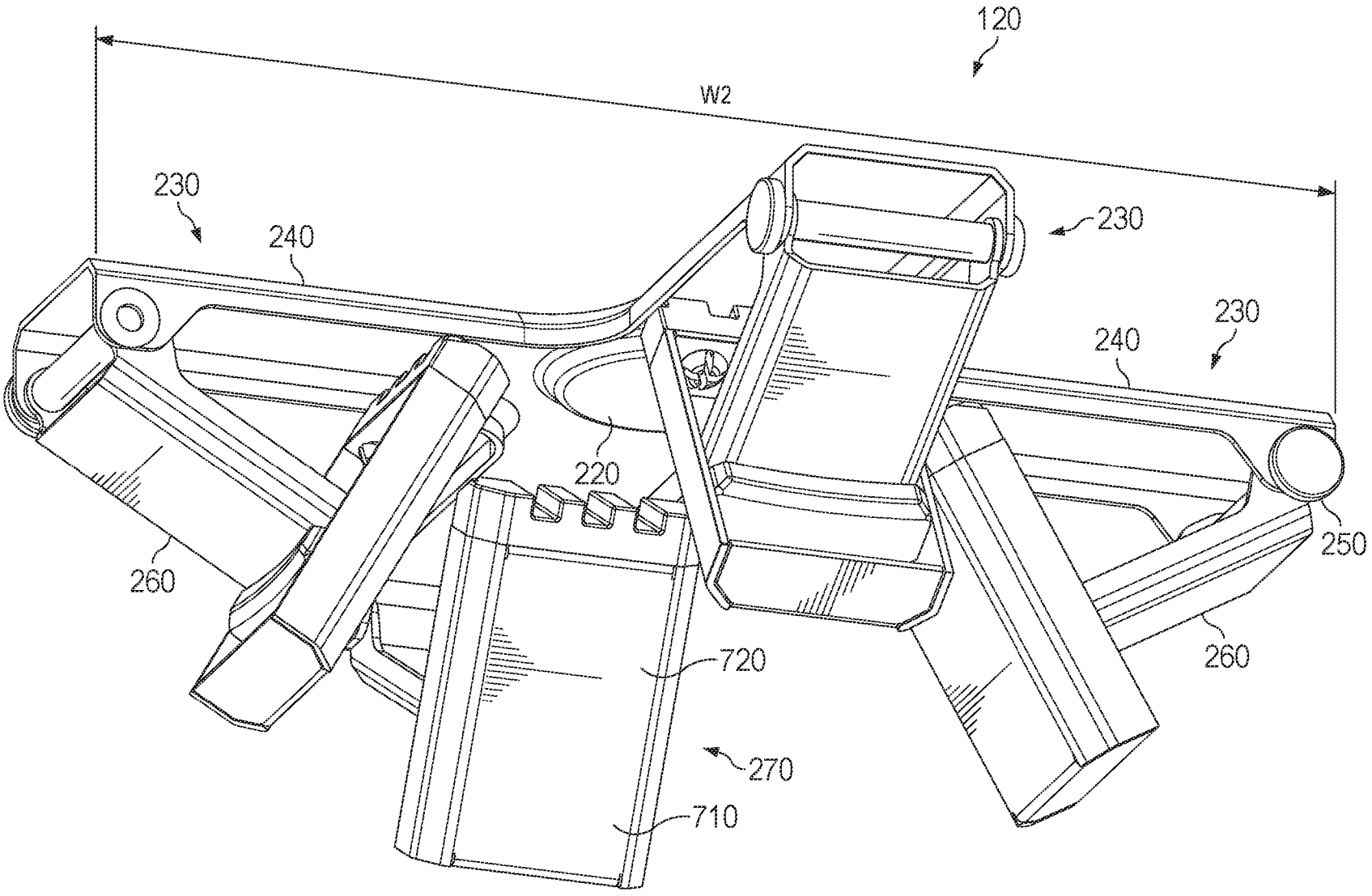
FIG. 8 is a top perspective view of the stand of an example stove and stand system, in a folded configuration, in accordance with aspects of the present disclosure.

FIG. 8 is a top perspective view of the stand 120 in a folded configuration. Visible are the central region 220, legs 230, inner links 240, hinges 250, outer links 260, feet 270, interference arms 710, and standoffs 720. In the example shown in FIG. 6, the outer links 260 have been rotated downward around the hinges 250 to the limit of their travel (e.g., until the feet 270 come in contact with the inner links 240). In the example shown in FIG. 6 each outer link 260 is separately rotatable, such that any number of legs (e.g., one leg, two legs, three legs, etc.) may be folded at any given time. When all of the legs are folded (e.g., in the example of FIG. 6, when all four outer links are rotated downward to the limit of their travel), the stand 120 has a folded width W2 that is smaller than the unfolded width W1 shown in FIG. 7.

In some embodiments, the legs 230 telescope rather than fold. In such embodiments, the hinges 250 may be absent, and the inner links 240 may be wider than the outer links 260, such that the outer links 260 can slide at least partially into the inner links 240, thus shortening the legs 230 such that the stand 120 has a telescoped width W2.

In the example shown in FIG. 8, the outer links 260 fold in only a single direction from parallel, e.g., downward. It is noted that if the exemplary stand of FIG. 6 included outer links 360 that were capable of folding upward, the stand might collapse under its own weight or under the weight of the stove body. However, it should be understood that in other embodiments, the outer links may rotate upward, leftward, rightward, clockwise, counterclockwise, or otherwise, without departing from the spirit of the present disclosure, so long as the stand 120 in its unfolded state is capable of supporting the stove body, and in its folded state is capable of having a smaller profile. In some examples, as described herein, the stand 120 may be folded to a size that permits placement within the stove body.

Figure 9:
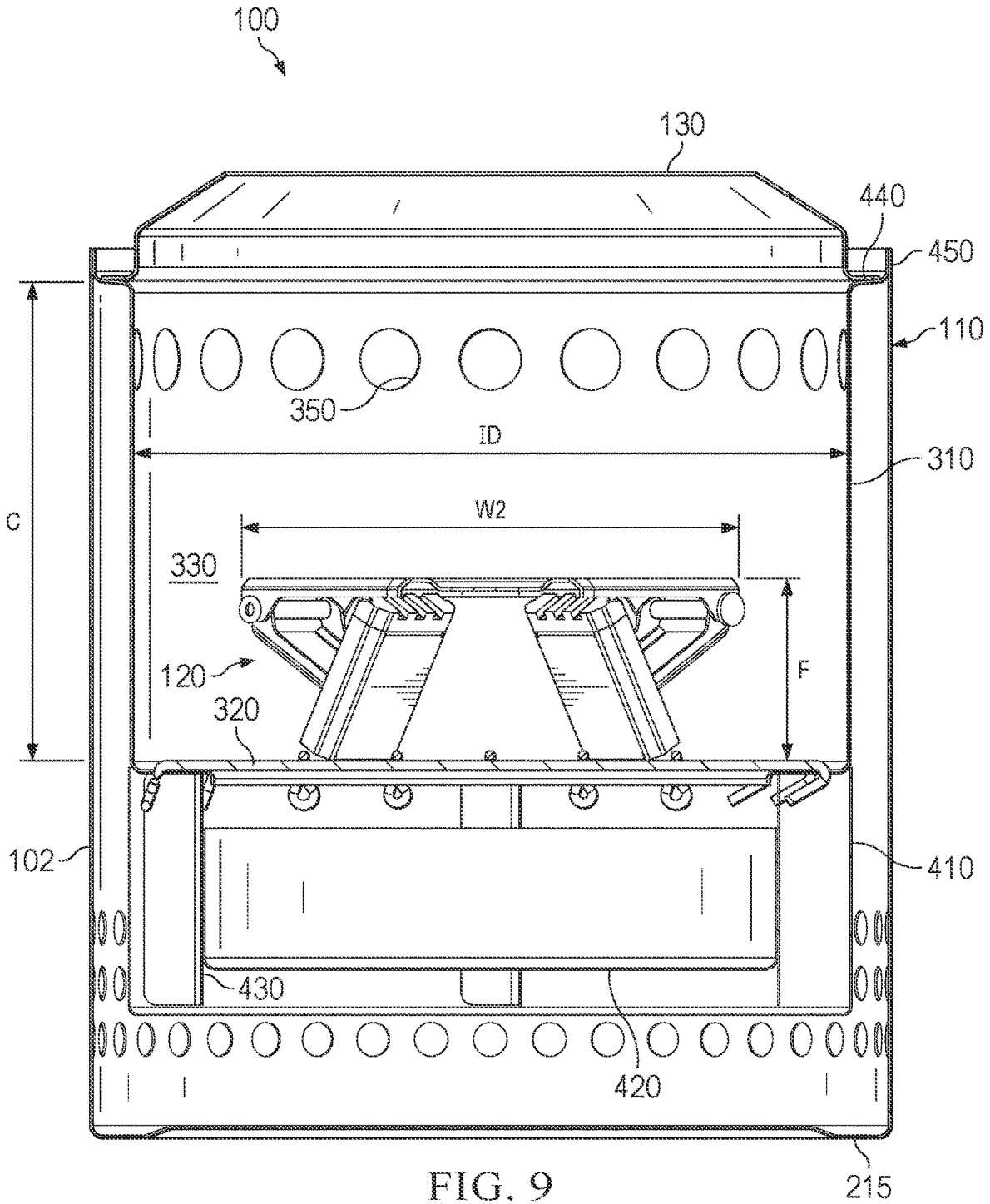
FIG. 9 is a front cross-sectional view of an example stove and stand system, with the stand stored inside the stove body, in accordance with aspects of the present disclosure.

FIG. 9 is a front cross-sectional view of an example stove and stand system 100, with the stand 120 placed inside the stove body 110, in accordance with aspects of the present disclosure. Visible are the stove body 110, top bezel or pot support 130, outer wall 210, top edge 450 of the outer wall 210, bottom surface 215, inner wall 310, top lip 440 of inner wall 310, fire grate 320, choke pan 410, ash pan 420, and an ash pan spacer 430.

In the example shown in FIG. 9, the stand 120 has been folded such that it has a folded width W2 that is less than the inner diameter ID of the inner wall. Similarly, the stand has a folded height F that is smaller than a height C of the inner wall 310 above the fire grate 320. Thus, the stand 120 in its folded state can be stored within the combustion chamber 330 of the stove body 110. Although shown with the width W2 being less than an inner width ID of the stove body 110, some implementations of the stand are greater than the width ID of the stove body 110, but the width W2 still fits within the volume of the combustion chamber 330. That is, in some implementations, the stand may be sized to be introduced into the combustion chamber by introducing the stand on its side.

Because the stand 120 is storable inside the stove body 110, the stove and stand system 100 advantageously takes up less storage space than if the stand 120 were permanently attached to the stove body 110, or non-foldable, or otherwise not storable within the stove body 110. This storage configuration also makes the stove and stand system 100 more easily transportable (e.g., in a backpack, duffel bag, suitcase, or picnic basket).

Depending on the implementation, the outer diameter OD of the stove body may fall in a range of between 6 inches and 16 inches, which the inner diameter ID is between 0.25" and 1.5" less than the outer diameter OD. The unfolded width W1 of the stand may be between one-eighth inch and seven-eighths inch less than the outer diameter OD of the stove body, while the folded width W2 may be between one half inch and six inches less than the inner diameter ID. However, in other examples, different dimensions, whether larger or smaller, may be used instead or in addition.

In an example, the top bezel or pot support 130, outer wall 210, bottom surface 215, top lip 440, choke pan 410, ash pan 420, and ash pan spacers are all formed from a metal such as stainless steel, and may for example be formed by stamping or rolling of sheet metal, or combinations thereof, with components or edges of components welded together as needed. In an example, the fire grate 320 is made from metal (e.g., stainless steel) bar or wire stock that is cut, bent, and welded to form the fire grate structure shown, or a different structure capable or serving the same function. In other embodiments, the fire grate 320 may also be made from stamped sheet metal such as stainless steel.

As will be readily appreciated by those having ordinary skill in the art after becoming familiar with the teachings herein, the disclosed stove and stand system advantageously provides a means to operate a solid-fuel-burning (e.g., wood-burning) stove on a non-heatproof surface, by providing a stand to offset the bottom surface of the stove from the non-heatproof surface by a safe height. The stand is also foldable, such that it can be stored inside the stove, thus providing a storage or transportation volume for the stove and stand system that is comparable to that of the stove by itself.

A number of variations are possible on the examples and embodiments described above. For example, the stove, stand, or portions thereof may be made from a variety of different materials, including but not limited to metals, ceramics, polymers, composites, or combinations thereof. Dimensions, both relative and absolute, may be different than those shown herein, without departing from the spirit of the present disclosure. The folding mechanism of the stand may be different than shown or described herein, so long as the width W1 of the unfolded configuration is sufficient to support the stove body as described, and the width W2 of the folded configuration is small enough that the stand can fit entirely inside the stove body in at least some orientations. The technology described herein may be applied to portable stoves, camp stoves, tabletop stoves, backyard firepits, or other types of stoves, and may further be applied to gas-burning or liquid-burning stoves.

Accordingly, the logical operations making up the embodiments of the technology described herein may be referred to variously as operations, steps, objects, elements, components, or modules. Furthermore, it should be understood that these may occur or be performed or arranged in any order, unless explicitly claimed otherwise or a specific order is inherently necessitated by the claim language.

All directional references e.g., upper, lower, inner, outer, upward, downward, left, right, lateral, front, back, top, bottom, above, below, vertical, horizontal, clockwise, counterclockwise, proximal, and distal are only used for identification purposes to aid the reader's understanding of the claimed subject matter, and do not create limitations, particularly as to the position, orientation, or use of the stove and stand system. Connection references, e.g., attached, coupled, connected, joined, or "in communication with" are to be construed broadly and may include intermediate members between a collection of elements and relative movement between elements unless otherwise indicated. As such, connection references do not necessarily imply that two elements are directly connected and in fixed relation to each other. The term "or" shall be interpreted to mean "and/or" rather than "exclusive or." The word "comprising" does not exclude other elements or steps, and the indefinite article "a" or "an" does not exclude a plurality. Unless otherwise noted in the claims, stated values shall be interpreted as illustrative only and shall not be taken to be limiting.

The above specification, examples and data provide a complete description of the structure and use of exemplary embodiments of the stove and stand system as defined in the claims. Although various embodiments of the claimed subject matter have been described above with a certain degree of particularity, or with reference to one or more individual embodiments, those skilled in the art could make numerous alterations to the disclosed embodiments without departing from the spirit or scope of the claimed subject matter.

Still other embodiments are contemplated. It is intended that all matter contained in the above description and shown in the accompanying drawings shall be interpreted as illustrative only of particular embodiments and not limiting. Changes in detail or structure may be made without departing from the basic elements of the subject matter as defined in the following claims.

What is claimed is:

1. A system for burning a combustible fuel above a placement surface, the system comprising:

a body, comprising:

an upper portion;

a lower portion;

an outer wall extending between the upper portion and the lower portion;

an inner wall that is tubular in shape so as to at least partially define a fuel combustion chamber, the inner wall being spaced from the outer wall to:

form a gap between the inner wall and the outer wall, and permit an upward flow of air in the gap between the inner wall and the outer wall;

a first plurality of ventilation holes formed through the outer wall proximate the lower portion of the body, the first plurality of ventilation holes being configured to permit airflow into the gap between the inner wall and the outer wall;

and a second plurality of ventilation holes formed through the inner wall proximate the upper portion of the body, the second plurality of ventilation holes being configured to permit airflow from the gap between the inner wall and the outer wall in a manner that facilitates secondary combustion of compounds emitted by fuel combustion in the fuel combustion chamber;

and a plurality of legs configured to support the body in a position spaced above the placement surface when the system is in a first configuration, each leg of the plurality of legs comprising:

a hinge;

an outer link pivotable about the hinge between a first state and a second state; and a foot connected to the outer link, opposite the hinge, and configured to contact the placement surface when the outer link is in the second state, wherein, in the first configuration of the system, the outer link of each leg of the plurality of legs is pivoted about the corresponding hinge to the second state to support the body in the position spaced above the placement surface, and wherein, in a second configuration of the system, the outer link of each leg of the plurality of legs is pivoted about the corresponding hinge to the first state.

2. The system of claim 1, wherein the first plurality of ventilation holes are formed in a plurality of rows through the outer wall proximate the lower portion of the body.

3. The system of claim 1, wherein, in the first configuration of the system, each leg of the plurality of legs extends outwardly, radially beyond the outer wall of the body.

4. The system of claim 1, wherein, in the second configuration of the system, each leg of the plurality of legs fits within a boundary defined by the outer wall of the body.

5. The system of claim 4, wherein, in the second configuration of the system, each leg of the plurality of legs is adapted to fit within a boundary defined by the inner wall of the body.

6. The system of claim 1, wherein each leg of the plurality of legs further comprises an inner link pivotably connected to the corresponding outer link via the corresponding hinge.

7. The system of claim 1, wherein at least a portion of the foot of each leg of the plurality of legs extends at an angle from the corresponding outer link.

8. The system of claim 1, wherein the plurality of legs at least partially form a stand.

9. The system of claim 8, wherein:

each leg of the plurality of legs further comprises an inner link pivotably connected to the corresponding outer link via the corresponding hinge; and the stand further comprises a central intersection from which the inner link of each leg of the plurality of legs radially extends.

10. The system of claim 8, wherein, in the first configuration of the system, the body is adapted to sit on the stand; and wherein, in the second configuration of the system, the body is removable from the stand.

11. The system of claim 10, wherein, in the second configuration of the system, the stand is adapted to fit within the fuel combustion chamber of the body.

12. The system of claim 1, wherein each ventilation hole of the first plurality of ventilation holes formed through the outer wall is sized smaller than each ventilation hole of the second plurality of ventilation holes formed through the inner wall.

13. A system for burning a combustible fuel above a placement surface, the system comprising:

a body, comprising:

an upper portion;

a lower portion;

an outer wall extending between the upper portion and the lower portion;

an inner wall that is tubular in shape so as to at least partially define a fuel combustion chamber, the inner wall being spaced from the outer wall to:

form a gap between the inner wall and the outer wall, and permit an upward flow of air in the gap between the inner wall and the outer wall;

and a plurality of legs configured to support the body in a position spaced above the placement surface when the system is in a first configuration, each leg of the plurality of legs comprising:

a hinge; and an outer link pivotable about the hinge between a first state and a second state.

14. The system of claim 13, wherein the body further comprises a plurality of ventilation holes formed through the outer wall proximate the lower portion of the body, the plurality of ventilation holes being configured to permit airflow into the gap between the inner wall and the outer wall.

15. The system of claim 14, wherein the plurality of ventilation holes are formed in a plurality of rows through the outer wall proximate the lower portion of the body.

16. The system of claim 13, wherein, in the first configuration of the system, the outer link of each leg of the plurality of legs is pivoted about the corresponding hinge to the second state to support the body in the position spaced above the placement surface; and wherein, in a second configuration of the system, the outer link of each leg of the plurality of legs is pivoted about the corresponding hinge to the first state.

17. The system of claim 16, wherein, in the second configuration of the system, each leg of the plurality of legs fits within a boundary defined by the outer wall of the body.

18. The system of claim 17, wherein, in the second configuration of the system, each leg of the plurality of legs is adapted to fit within a boundary defined by the inner wall of the body.

19. The system of claim 13, wherein, in the first configuration of the system, each leg of the plurality of legs extends outwardly, radially beyond the outer wall of the body.

20. The system of claim 13, wherein each leg of the plurality of legs further comprises an inner link pivotably connected to the corresponding outer link via the corresponding hinge.

21. The system of claim 13, wherein each leg of the plurality of legs further comprises a foot connected to the outer link, opposite the hinge, and configured to contact the placement surface when the outer link is in the second state; and wherein at least a portion of the foot of each leg of the plurality of legs extends at an angle from the corresponding outer link.

22. The system of claim 13, wherein the body further comprises a plurality of ventilation holes formed through the inner wall proximate the upper portion of the body, the plurality of ventilation holes being configured to permit airflow from the gap between the inner wall and the outer wall in a manner that facilitates secondary combustion of compounds emitted by fuel combustion in the fuel combustion chamber.

23. The system of claim 13, wherein:

the plurality of legs at least partially form a stand;

each leg of the plurality of legs further comprises an inner link pivotably connected to the corresponding outer link via the corresponding hinge; and the stand further comprises a central intersection from which the inner link of each leg of the plurality of legs radially extends.

24. The system of claim 13, wherein the body further comprises:

a first plurality of ventilation holes formed through the outer wall proximate the lower portion of the body, the first plurality of ventilation holes being configured to permit airflow into the gap between the inner wall and the outer wall; and a second plurality of ventilation holes formed through the inner wall proximate the upper portion of the body, the second plurality of ventilation holes being configured to permit airflow from the gap between the inner wall and the outer wall in a manner that facilitates secondary combustion of compounds emitted by fuel combustion in the fuel combustion chamber;

and wherein each ventilation hole of the first plurality of ventilation holes formed through the outer wall is sized smaller than each ventilation hole of the second plurality of ventilation holes formed through the inner wall.

25. A system for burning a combustible fuel above a placement surface, the system comprising:

a body, comprising:

an upper portion;

a lower portion;

an outer wall extending between the upper portion and the lower portion;

an inner wall that is tubular in shape so as to at least partially define a fuel combustion chamber, the inner wall being spaced from the outer wall to:

form a gap between the inner wall and the outer wall, and permit an upward flow of air in the gap between the inner wall and the outer wall;

a first plurality of ventilation holes formed through the outer wall proximate the lower portion of the body, the first plurality of ventilation holes being configured to permit airflow into the gap between the inner wall and the outer wall; and a second plurality of ventilation holes formed through the inner wall proximate the upper portion of the body, the second plurality of ventilation holes being configured to permit airflow from the gap between the inner wall and the outer wall in a manner that facilitates secondary combustion of compounds emitted by fuel combustion in the fuel combustion chamber;

and a plurality of legs configured to support the body in a position spaced above the placement surface, each leg of the plurality of legs comprising:

an inner link;

a hinge connected to the inner link; and an outer link pivotable about the hinge, and relative to the inner link, between a first state and a second state.

26. The system of claim 25, wherein the first plurality of ventilation holes are formed in a plurality of rows through the outer wall proximate the lower portion of the body.

27. The system of claim 25, wherein each ventilation hole of the first plurality of ventilation holes formed through the outer wall is sized smaller than each ventilation hole of the second plurality of ventilation holes formed through the inner wall.

28. The system of claim 25, wherein each leg of the plurality of legs further comprises a foot connected to the outer link, opposite the hinge, and configured to contact the placement surface when the outer link is in the second state.

29. The system of claim 25, wherein the body further comprises a bottom surface disposed below the fuel combustion chamber; and wherein each leg of the plurality of legs is configured to contact the bottom surface at least when the body is supported by the plurality of legs in the position spaced above the placement surface.

30. The system of claim 25, wherein each leg of the plurality of legs extends outwardly, radially beyond the outer wall of the body, at least when the body is supported by the plurality of legs in the position spaced above the placement surface.

* * * * *